US010636373B2

(12) United States Patent
Wang et al.

(10) Patent No.: US 10,636,373 B2
(45) Date of Patent: Apr. 28, 2020

(54) PIXEL CIRCUIT, MEMORY CIRCUIT, DISPLAY PANEL AND DRIVING METHOD

(71) Applicants: BOE Technology Group Co., Ltd., Beijing (CN); Hefei BOE Optoelectronics Technology Co., Ltd., Hefei (CN)

(72) Inventors: Xiujuan Wang, Beijing (CN); Xianjie Shao, Beijing (CN); Yimin Chen, Beijing (CN)

(73) Assignees: BOE Technology Group Co., Ltd., Beijing (CN); Hefei BOE Optoelectronics Technology Co., Ltd., Hefei (CN)

( * ) Notice: Subject to any disclaimer, the term of this patent is extended or adjusted under 35 U.S.C. 154(b) by 120 days.

(21) Appl. No.: 15/928,396

(22) Filed: Mar. 22, 2018

(65) Prior Publication Data

US 2019/0088223 A1 Mar. 21, 2019

(30) Foreign Application Priority Data

Sep. 20, 2017 (CN) ..... 2017 1 0854832

(51) Int. Cl.
*G09G 3/36* (2006.01)

(52) U.S. Cl.
CPC ..... *G09G 3/3648* (2013.01); *G09G 3/3614* (2013.01); *G09G 2300/0857* (2013.01); *G09G 2330/021* (2013.01)

(58) Field of Classification Search
CPC ..... G09G 3/3648; G09G 2300/0857; G09G 2330/021; G09G 3/3614
See application file for complete search history.

(56) References Cited

U.S. PATENT DOCUMENTS 6,765,549 B1 * 7/2004 Yamazaki ..... G09G 3/3266 345/80
2018/0114497 A1 * 4/2018 Tan ..... G09G 3/3648

FOREIGN PATENT DOCUMENTS

WO WO-2017121093 A1 * 7/2017 ..... G09G 3/3648

* cited by examiner

*Primary Examiner* — Stacy Khoo
(74) *Attorney, Agent, or Firm* — Banner & Witcoff, Ltd.

(57) ABSTRACT

A pixel circuit, a memory circuit, a display panel and a driving method. The pixel circuit includes a data writing circuit, a signal storage circuit and a display driving circuit. The data writing circuit is configured to write a data signal into the signal storage circuit according to a scan signal, the signal storage circuit is configured to store the data signal and control the display driving circuit to perform driving for display according to the data signal. The signal storage circuit comprises a first switch, a second switch, a third switch, a first node and a second node.

17 Claims, 6 Drawing Sheets

PIXEL CIRCUIT, MEMORY CIRCUIT, DISPLAY PANEL AND DRIVING METHOD

This application claims priority to and the benefit of Chinese Patent Application No. 201710854832.3 filed on Sep. 20, 2017, which application is incorporated herein in its entirety.

TECHNICAL FIELD

The present disclosure relates to a pixel circuit, a memory circuit, a display panel and a driving method.

BACKGROUND

At present, mainstream displays are developing in a trend of high quality with the other trend of power consumption. For example, in a wearable device, an ultralow power reflective liquid crystal display (LCD) module that does not use a backlight can be adopted to reduce power consumption. In addition, in order to further reduce power consumption, it is also possible to utilize the MIP (Memory in Pixel) technology that stores image information by use of the memory embedded in pixels, so that a user can use the wearable device for a long time without worrying about the power consumption.

SUMMARY

At least one embodiment of the present disclosure provides a pixel circuit, comprising a data writing circuit, a signal storage circuit and a display driving circuit. The data writing circuit is configured to write a data signal into the signal storage circuit according to a scan signal, and the signal storage circuit is configured to store the data signal and control the display driving circuit to perform driving for display according to the data signal. The signal storage circuit comprises a first switch, a second switch, a third switch, a first node and a second node. A first electrode and a control electrode of the first switch are both electrically connected with the first node, and a second electrode of the first switch is configured to be electrically connected with a first voltage terminal; a first electrode and a control electrode of the second switch are both configured to be electrically connected with the first voltage terminal, and a second electrode of the second switch is electrically connected with the second node; and a control electrode of the third switch is electrically connected with the first node, a first electrode of the third switch is electrically connected with the second node, and a second electrode of the third switch is electrically connected with a second voltage terminal.

For example, in a pixel circuit provided by an embodiment of the present disclosure, a voltage output by the first voltage terminal is higher than a voltage output by the second voltage terminal.

For example, in a pixel circuit provided by an embodiment of the present disclosure, the first switch, the second switch and the third switch are thin film transistors.

For example, in a pixel circuit provided by an embodiment of the present disclosure, the first switch, the second switch and the third switch are N-type transistors.

For example, in a pixel circuit provided by an embodiment of the present disclosure, the data writing circuit comprises a fourth switch, a control electrode of the fourth switch is electrically connected with a gate line to receive the scan signal, a first electrode of the fourth switch is electrically connected with a data line to receive the data signal, and a second electrode of the fourth switch is electrically connected with the first node.

For example, in a pixel circuit provided by an embodiment of the present disclosure, the display driving circuit comprises a fifth switch, a sixth switch and a third node. The fifth switch is connected with the third node and a first display signal line, the sixth switch is connected with the third node and a second display signal line. The fifth switch is configured to apply a signal inputted from the first display signal line to the third node under a control of a level of the first node, and the sixth switch is configured to apply a signal inputted from the second display signal line to the third node under a control of a level of the second node; or the fifth switch is configured to apply a level of the first node to the third node under a control of a signal inputted from the first display signal line, and the sixth switch is configured to apply a level of the second node to the third node under a control of a signal inputted from the second display signal line.

For example, in a pixel circuit provided by an embodiment of the present disclosure, a control electrode of the fifth switch is electrically connected with the first node, a first electrode of the fifth switch is electrically connected with the first display signal line, and a second electrode of the fifth switch is electrically connected with the third node; or a control electrode of the fifth switch is electrically connected with the first display signal line, a first electrode of the fifth switch is electrically connected with the first node, and a second electrode of the fifth switch is electrically connected with the third node.

For example, in a pixel circuit provided by an embodiment of the present disclosure, a control electrode of the sixth switch is electrically connected with the second node, a first electrode of the sixth switch is electrically connected with the second display signal line, and a second electrode of the sixth switch is electrically connected with the third node; or a control electrode of the sixth switch is electrically connected with the second display signal line, a first electrode of the sixth switch is electrically connected with the second node, and a second electrode of the sixth switch is electrically connected with the third node.

For example, in a pixel circuit provided by an embodiment of the present disclosure, the fifth switch and the sixth switch are thin film transistors.

For example, in a pixel circuit provided by an embodiment of the present disclosure, the fifth switch and the sixth switch are N-type transistors.

For example, in a pixel circuit provided by an embodiment of the present disclosure, the first display signal line is configured to be electrically connected with one of the first voltage terminal and the second voltage terminal, and the second display signal line is configured to be electrically connected with the other of the first voltage terminal and the second voltage terminal.

For example, in a pixel circuit provided by an embodiment of the present disclosure, the data writing circuit is connected with the first node, and the display driving circuit is connected with the first node and the second node.

At least one embodiment of the present disclosure further provides a memory circuit, comprising a first switch, a second switch, a third switch, a first node and a second node. A first electrode and a control electrode of the first switch are both electrically connected with the first node, and a second electrode of the first switch is configured to be electrically connected with a first voltage terminal; a first electrode and a control electrode of the second switch are both configured to be electrically connected with the first voltage terminal, and a second electrode of the second switch is electrically connected with the second node; and a control electrode of the third switch is electrically connected with the first node, a first electrode of the third switch is electrically connected with the second node, and a second electrode of the third switch is electrically connected with a second voltage terminal.

At least one embodiment of the present disclosure further provides a display panel, comprising a plurality of pixel units, and each of the pixel unit comprises the pixel circuit provided by the embodiments of the present disclosure.

At least one embodiment of the present disclosure further provides a driving method of the pixel circuit, comprising: applying a signal to the third node through the first display signal line to cause the pixel circuit display a black state or a white state; and applying a signal to the third node through the second display signal line to cause the pixel circuit to display the white state or the black state.

For example, in a driving method of the pixel circuit provided by an embodiment of the present disclosure, signals applied through the first display signal line and the second display signal line comprise a direct current signal and an alternating current square wave signal.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1:
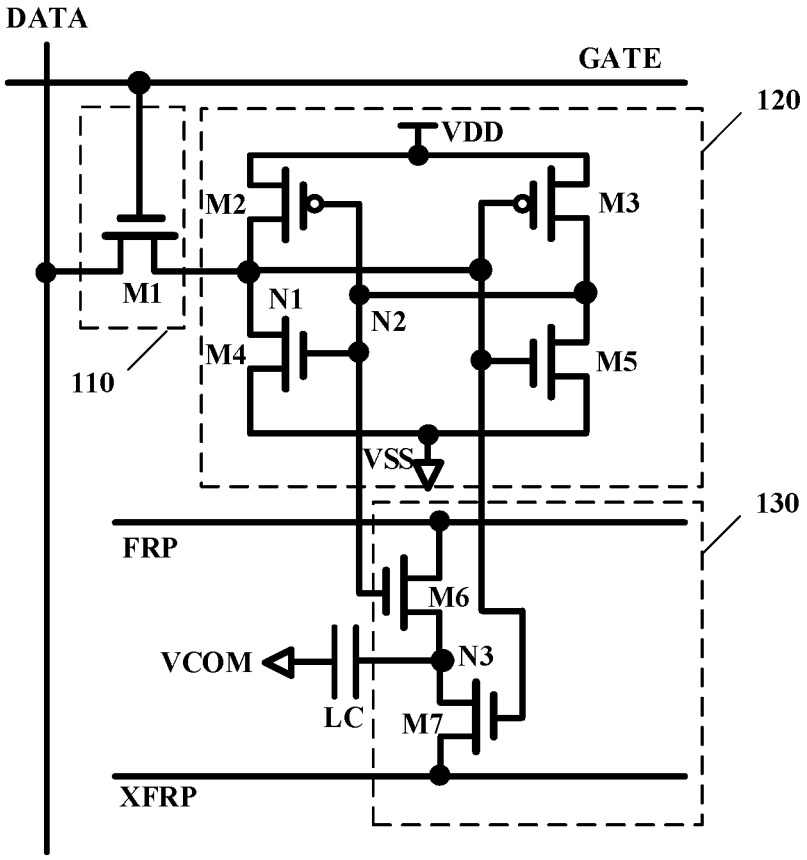
FIG. 1 is a schematic diagram of a pixel circuit.

FIG. 1 shows a pixel circuit, which can be used to drive a pixel unit in a reflective liquid crystal display panel adopting the MIP (Memory in Pixel) technology for displaying. As shown in FIG. 1, the pixel circuit includes a data writing circuit 110, a signal storage circuit 120 and a display driving circuit 130.

As shown in FIG. 1, in more detail, the data writing circuit 110 includes a first switch M1, a control electrode of the first switch M1 is connected with a scan signal line GATE to receive a scan signal, a first electrode of the first switch M1 is connected with a data signal line DATA to receive a data signal, and a second electrode of the first switch M1 is connected with a first node N1.

The signal storage circuit 120 includes: a second switch M2 having a control electrode connected with a second node N2, a first electrode connected with a first voltage terminal VDD (for example, which inputs a direct current high level), and a second electrode connected with the first node N1; a third switch M3 having a control electrode connected with the first node N1, a first electrode connected with the first voltage terminal VDD, and a second electrode connected with the second node N2; a fourth switch M4 having a control electrode connected with the second node N2, a first electrode connected with the first node N1, and a second electrode connected with a second voltage terminal VSS (for example, which inputs a direct current low level); and a fifth switch M5 having a control electrode connected with the first node N1, a first electrode connected with the second node N2, and a second electrode connected with the second voltage terminal VSS.

The display driving circuit 130 includes: a sixth switch M6 having a control electrode connected with the second node N2, a first electrode connected with a first display signal line FRP, and a second electrode connected with a third node N3; and a seventh switch M7 having a control electrode connected with the first node N1, a first electrode connected with the third node N3, and a second electrode connected with a second display signal line XFRP.

For example, the third node N3 can be electrically connected with one end of a display unit LC, and a common electrode terminal VCOM can be electrically connected with the other end of the display unit LC. The display unit LC can display a black state or a white state under the cooperation of signals inputted from the third node N3 and the common electrode terminal VCOM. For example, two electrodes of the display unit LC can be respectively a pixel electrode and a common electrode.

For example, each switch as shown in FIG. 1 can employ a thin film transistor, and a gate electrode of the thin film transistor can be used as the control electrode of the switch. As shown in FIG. 1, the second switch M2 and the third switch M3 are P-type transistors, and the remaining switches are N-type transistors.

For example, the second display signal line XFRP can be connected with a high level terminal or the first voltage terminal VDD to keep inputting a direct current high level signal. For example, the first display signal line FRP can be connected with a low level terminal (the level of which is lower than the lever of the high level terminal) or the second voltage terminal VSS to keep inputting a direct current low level signal. For another example, the common electrode terminal VCOM can be connected with a low level terminal or the second voltage terminal VSS to keep inputting a direct current low level signal. The following describes the operation principle of the pixel circuit as shown in FIG. 1 in two cases according to the levels of the data signals inputted by the data signal line DATA.

(1) When the scan signal line GATE inputs a scan on signal (that is turning-on signal), the first switch M1 is turned on. At this time, if the data signal inputted by the data signal line DATA is a high level signal, the potential of the first node N1 is high because the first switch M1 is turned on. Because the potential of the first node N1 is high, the third switch M3 is turned off, and the fifth switch M5 is turned on. The turning-on state of the fifth switch M5 electrically connects the second node N2 and the second voltage terminal VSS, so that the potential of the second node N2 is pulled down to a low level. Because the potential of the second node N2 becomes low, the second switch M2 is turned on, and the fourth switch M4 and the sixth switch M6 are turned off. The turning-on state of the second switch M2 cause the high level signal inputted by the first voltage terminal VDD to keep charging the first node N1, so that the potential of the first node is kept at a high level.

At the same time, because the potential of the first node N1 is high, the seventh switch M7 is turned on, so that the high level signal inputted by the second display signal line XFRP is applied to the third node N3. Because the common electrode terminal VCOM inputs a low level signal, signals applied to the two ends of the display unit LC are a high level signal and a low level signal respectively which are opposite to each other at this time, and the voltage difference between the high level signal and the low level signal which are opposite to each other can allow the pixel unit driven by the pixel circuit to display a white state.

(2) When the scan signal line GATE inputs a scan on signal, the first switch M1 is turned on. At this time, if the data signal inputted by the data signal line DATA is a low level signal, the potential of the first node N1 is low because the first switch M1 is turned on. Because the potential of the first node N1 is low, the third switch M3 is turned on, and the fifth switch M5 and the seventh switch M7 are turned off. The turning-on state of the third switch M3 electrically connects the second node N2 and the first voltage terminal VDD, so that the potential of the second node N2 is charged to a high level. Because the potential of the second node N2 is high, the second switch M2 is turned off, and the fourth switch M4 and the sixth switch M6 are turned on. The turning-on state of the fourth switch M4 connects the first node N1 and the second voltage terminal VSS, so that the potential of the first node is kept at a low level.

At the same time, because the sixth switch M6 is turned on, a low level signal inputted by the first display signal line FRP is applied to the third node N3. Because the common electrode terminal VCOM also inputs a low level signal, signals applied to the two ends of the display unit LC are both low level signals at this time, so that the pixel unit driven by the pixel circuit displays a black state.

If there is a leakage current in the fourth switch M4 and the fifth switch M5 during the operation of the above described pixel circuit, the holding effect of the potentials of the first node N1 and the second node N2 will be affected, and in turn the display effect of the display panel using the pixel circuit will be affected.

At least one embodiment of the present disclosure provides a pixel circuit including a data writing circuit, a signal storage circuit and a display driving circuit. The data writing circuit is configured to write a data signal into the signal storage circuit according to a scan signal, and the signal storage circuit is configured to store the data signal and control the display driving circuit to perform driving for display according to the data signal. The signal storage circuit includes a first switch, a second switch, a third switch, a first node and a second node. A first electrode and a control electrode of the first switch are both electrically connected with the first node, and a second electrode of the first switch is configured to be electrically connected with a first voltage terminal. A first electrode and a control electrode of the second switch are both configured to be electrically connected with the first voltage terminal, and a second electrode of the second switch is electrically connected with the second node. A control electrode of the third switch is electrically connected with the first node, a first electrode of the third switch is electrically connected with the second node, and a second electrode of the third switch is electrically connected with a second voltage terminal.

At least one embodiment of the present disclosure further provides a memory circuit, a display panel and a driving method corresponding to the above pixel circuit.

The pixel circuit, the memory circuit, the display panel and the driving method provided in the embodiments of the present disclosure can reduce the number of switches used for the pixel circuit or memory circuit, reduce the occupied area of a substrate by the circuit, and improve the signal holding capability of the circuit.

The embodiments of the present disclosure and examples thereof will be described in detail below with reference to the accompanying drawings.

Figure 2:
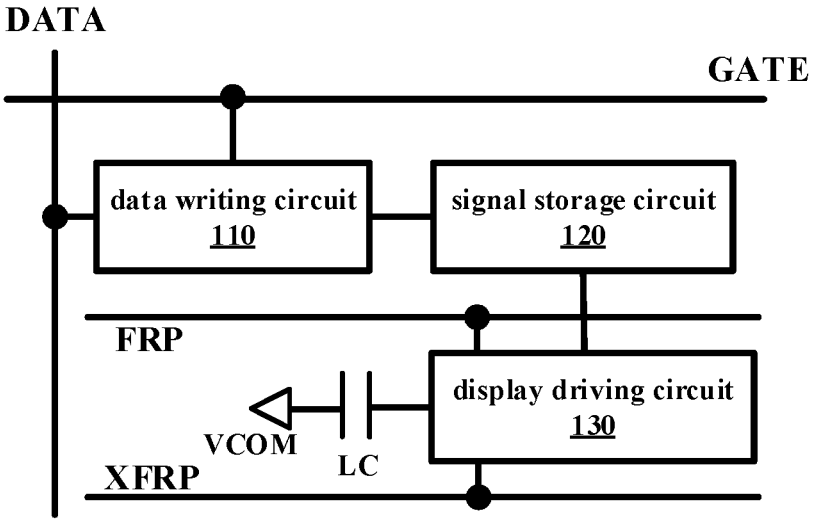
FIG. 2 is a schematic block diagram of a pixel circuit according to an embodiment of the present disclosure.

An example of the embodiment of the present disclosure provides a pixel circuit 100. As shown in FIG. 2, the pixel circuit 100 includes a data writing circuit 110, a signal storage circuit 120, and a display driving circuit 130.

The data writing circuit 110 is configured to write a data signal into the signal storage circuit 120 according to a scan signal. For example, the data writing circuit 110 can be configured to be connected with the gate line GATE and the data line DATA to write the data signal inputted by the data line DATA into the signal storage circuit 120 under the control of the scan signal inputted by the gate line GATE.

The signal storage circuit 120 is configured to store the data signal and control the display driving circuit 130 to perform driving for display according to the data signal. For example, the display driving circuit can be configured to be connected with the first display signal line FRP and the second display signal line XFRP, so as to drive one end of the display unit LC. For example, the other end of the LC can be connected with the common electrode terminal VCOM.

When the above pixel circuit 100 is used for driving the pixel unit of a display panel to display, for example, in the first frame timing, after the data writing circuit 110 writes the data signal into the signal storage circuit 120, the data signal can be stored in the signal storage circuit 120. In the subsequent frame timings for displaying, the stored data signal can be continuously used when it is not necessary to update the displayed content of pixel unit. It is not necessary to write the data signal into each pixel unit frame by frame via the data line DATA and the data writing circuit 110 by the way of, for example, a normal line-by-line scan method, so the power consumption reduction effect can be achieved.

Figure 3:
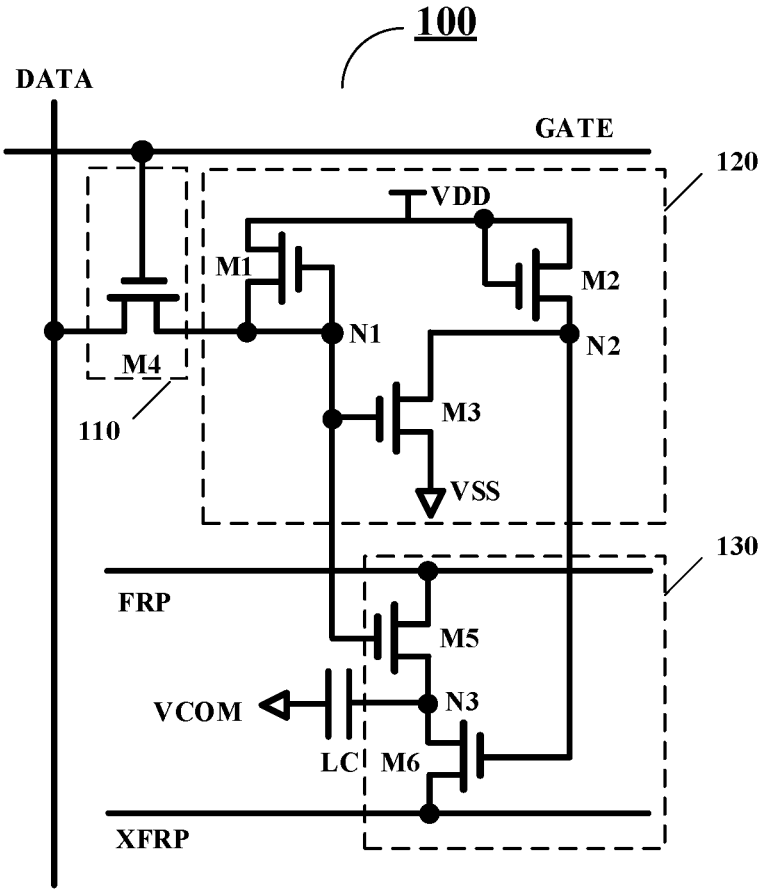
FIG. 3 is a schematic diagram of a pixel circuit according to an example of an embodiment of the present disclosure.

For example, as shown in FIG. 3, in one example, the signal storage circuit 120 can be implemented to include a first switch M1, a second switch M2, a third switch M3, a first node N1 and a second node N2.

A first electrode and a control electrode of the first switch M1 are both electrically connected with the first node N1, and the second electrode of the first switch M1 is configured to be electrically connected with a first voltage terminal VDD. Because the control electrode of the first switch M1 is electrically connected with the first node N1, the first switch M1 can be turned on or off under the control of the level of the first node N1.

For example, the first voltage terminal VDD is a high voltage terminal, for example, configured to input a direct current high level signal (for example, which can turn on an N-type transistor applied in this embodiment), and the following embodiments are the same and will not be repeated herein.

A first electrode and a control electrode of the second switch M2 are both configured to be electrically connected with the first voltage terminal VDD, and a second electrode of the second switch M2 is electrically connected with the second node N2. Because the control electrode of the second switch M2 is electrically connected with the first voltage terminal VDD, the second switch M2 remains in the turning-on state.

A control electrode of the third switch M3 is electrically connected with the first node N1, so that the third switch M3 can be turned on or off under the control of the level of the first node N1. A first electrode of the third switch M3 is electrically connected with the second node N2, a second electrode of the third switch M3 is electrically connected with the second voltage terminal VSS, and the second voltage terminal VSS is different from the first voltage terminal VDD.

For example, the second voltage terminal VSS is a low voltage terminal (lower than the first voltage terminal VDD), for example, configured to input a direct current low level signal, and the following embodiments are the same and will not be repeated herein.

For another example, as shown in FIG. 3, in one example, the data writing circuit 110 can be implemented as a fourth switch M4. A control electrode of the fourth switch M4 is electrically connected with the gate line GATE to receive the scan signal, so the fourth switch M4 can be turned on or off under the control of the scan signal. A first electrode of the fourth switch M4 is electrically connected with the data line DATA to receive the data signal, and a second electrode of the fourth switch M4 is electrically connected with the first node N1. The fourth switch M4 can write the received data signal into the first node N1, that is, the signal storage circuit 120, under the condition that the scan signal controls the conduction of the fourth switch M4.

For another example, as shown in FIG. 3, in one example, the display driving circuit 130 can be implemented to include a fifth switch M5, a sixth switch M6 and a third node N3.

For example, when the pixel circuit is used in a display panel, the third node N3 can be electrically connected with one end of a display unit LC, and the common electrode terminal VCOM can be electrically connected with the other end of the display unit LC. The display unit LC can display a black state or a white state under the combined effect of signals inputted from the third node N3 and the common electrode terminal VCOM. For example, two electrodes of the display unit LC can be respectively a pixel electrode and a common electrode. For example, the common electrode can be electrically connected with the common electrode terminal VCOM through a common electrode line.

The fifth switch M5 is connected with the third node N3 and the first display signal line FRP, and the fifth switch M5 is configured to apply the signal inputted from the first display signal line FRP to the third node N3 under the control of the level of the first node N1. For example, the fifth switch M5 can be configured to be turned on under the control of the level of the first node N1 so as to apply the signal inputted from the first display signal line FRP to the third node N3.

The sixth switch M6 is connected with the third node N3 and the second display signal line XFRP, and the sixth switch M6 is configured to apply the signal inputted from the second display signal line XFRP to the third node N3 under the control of the level of the second node N2. For example, the sixth switch M6 can be configured to be turned on under the control of the level of the second node N2 so as to apply the signal inputted from the second display signal line XFRP to the third node N3.

For example, for a display panel of normally black mode, the signal applied to the third node N3 can cooperate with the signal inputted from the common electrode terminal VCOM, so the voltage difference applied across the display unit LC is relatively high, and the pixel unit driven by the pixel circuit displays a white state. Alternatively, the signal applied to the third node N3 can cooperate with the signal inputted from the common electrode terminal VCOM, so the voltage difference applied across the display unit LC is relatively low (e.g., zero), and the pixel unit driven by the pixel circuit displays a black state.

In addition, it should be noted that, for a display panel of normally white mode, a white state is displayed when the voltage difference across the display unit LC is at a low level, and a black state is displayed when the voltage difference across the display unit LC is at a high level.

For example, as shown in FIG. 3, in more detail, a control electrode of the fifth switch M5 is electrically connected with the first node N1, so the fifth switch M5 can be turned on or off under the control of the level of the first node N1. A first electrode of the fifth switch M5 is electrically connected with the first display signal line FRP, and a second electrode of the fifth switch M5 is electrically connected with the third node N3.

A control electrode of the sixth switch M6 is electrically connected with the second node N2, so the sixth switch M6 can be turned on or off under the control of the level of the second node N2. A first electrode of the sixth switch M6 is electrically connected with the second display signal line XFRP, and a second electrode of the sixth switch M6 is electrically connected with the third node N3.

Each of the switches in the pixel circuit provided in the embodiments of the present disclosure can adopt a thin film transistor, and in this case, the gate electrode of the thin film transistor functions as the control electrode of the switch. It should be noted that, the embodiments of the present disclosure do not limit the types of the switches. For example, the switches can also adopt field-effect transistors or other switches with the same characteristics.

Further, each of the switches can adopt an N-type thin film transistor. In this case, the first electrode can be a drain electrode and the second electrode can be a source electrode. It should be noted that, the embodiments of the present disclosure include, but are not limited to, the examples. For example, one or more switches in the pixel circuit provided in the embodiments of the present disclosure can also adopt P-type thin film transistors. In this case, the first electrode can be a source electrode and the second electrode can be a drain electrode. For a different type of transistor, each electrode of this transistors need to be correspondingly connected with reference to each electrode of the transistors employed in examples of the embodiments of the present disclosure.

Figure 4:
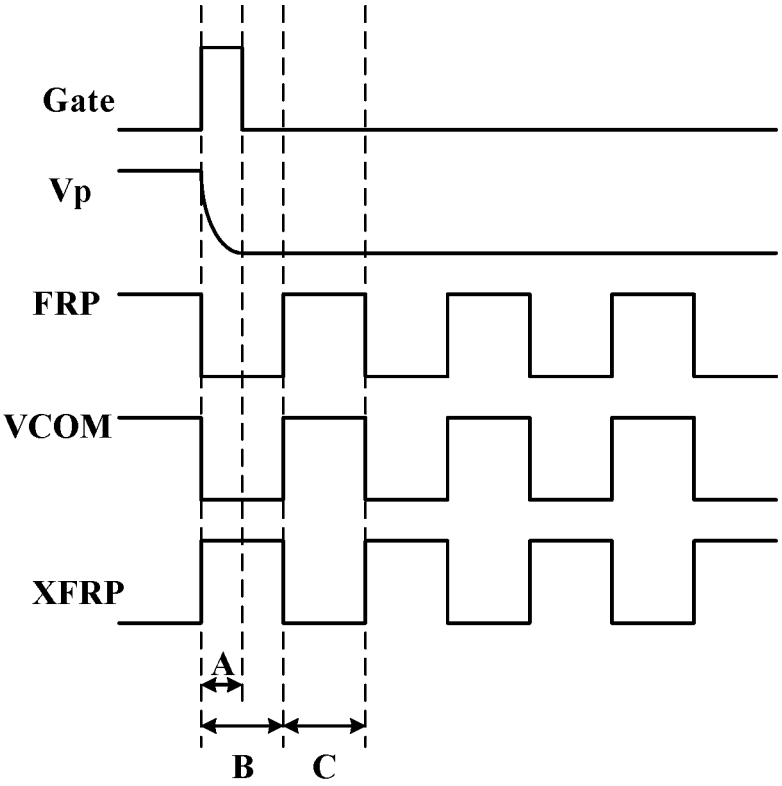
FIG. 4 is a first signal timing diagram of a pixel circuit provided in an embodiment of the present disclosure.
Figure 5:
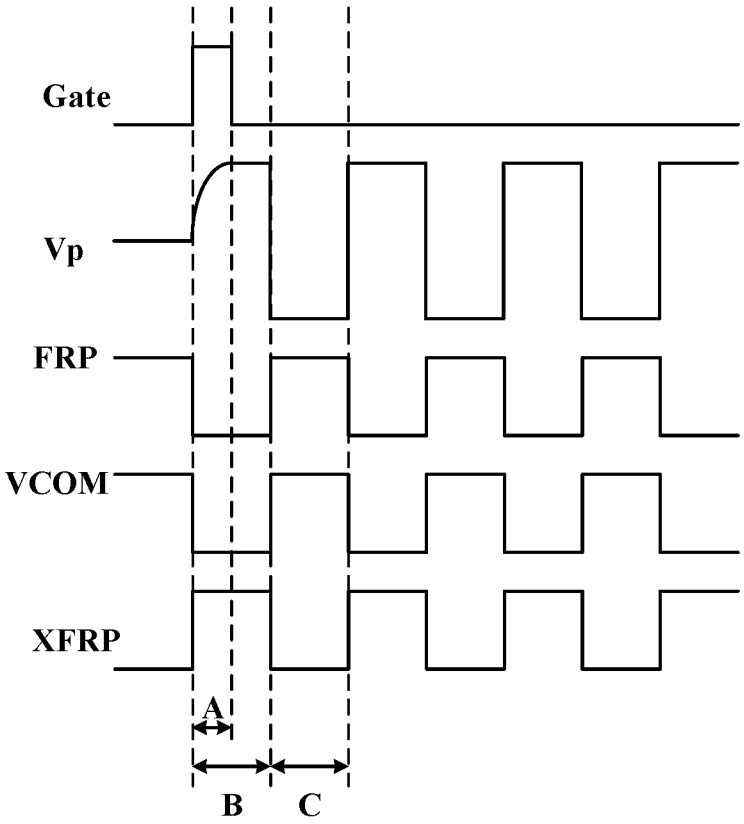
FIG. 5 is a second signal timing diagram of a pixel circuit provided in an embodiment of the present disclosure.

FIG. 4 and FIG. 5 are signal timing diagrams when the pixel circuit as shown in FIG. 3 is in operation. FIG. 4 shows a signal timing diagram when the display by the pixel unit changes from a white state to a black state, and FIG. 5 shows a signal timing diagram when the display by the pixel unit changes from a black state to a white state.

It should be noted that the reference Vp shown in FIG. 4 or FIG. 5 represents the voltage difference between the third node N3 and the common electrode terminal VCOM, that is, the voltage difference applied across the display unit LC. For example, for the normally black mode, when the amplitude of the voltage difference Vp is low, the corresponding pixel unit displays a black state; when the amplitude of the voltage difference Vp is high, the corresponding pixel unit displays a white state. In addition, the level of the voltage difference Vp here refers to the magnitude of the voltage difference Vp, that is, the absolute value of the voltage difference Vp. For example, when the voltage difference Vp is at a high level, the situation that the voltage difference Vp involves a negative value is also included. The following embodiments are the same for Vp and will not be repeated herein.

The operation principle of the pixel circuit 100 as shown in FIG. 3 will be described in two cases in combination with the signal timing diagrams as shown in FIG. 4 and FIG. 5 according to the level of the data signal inputted by the data line DATA.

(1) From White State to Black State

As shown in FIG. 3 and FIG. 4, when the gate line GATE inputs a scan on signal (as shown in phase A of FIG. 4), the fourth switch M4 is turned on. At this time, if the data signal inputted by the data line DATA is a high level signal, the fourth switch M4 is turned on, so that the potential of the first node N1 is at a high level. Because the potential of the first node N1 is high, the first switch M1 is turned on, and the first node N1 is connected with the first voltage terminal VDD. So the first node N1 can be kept at a high level.

Because the potential of the first node N1 is at a high level, the third switch M3 is turned on, and the second node N2 is connected with the second voltage terminal VSS. At the same time, because the control electrode of the second switch M2 is connected with the first voltage terminal VDD, the second switch M2 remains in the turning-on state. For example, in the case that both of the second switch M2 and the third switch M3 are N-type thin film transistors, the second switch M2 and the third switch M3 can be configured (for example, aspect ratio, threshold voltages, etc. of these switches) when the second switch M2 and the third switch M3 are both turned on, the potential of the second node N2 is pulled down to a lower level, which does not cause the sixth switch M6 to turn on.

At the same time, because the potential of the first node N1 is high, the fifth switch M5 is turned on, and the signal inputted by the first display signal line FRP is applied to the third node N3. For example, as shown in FIG. 4, the first display signal line FRP and the common electrode terminal VCOM can be configured to input the same alternating current square wave signals (at a high level or a low level at the same time), so the amplitude of the voltage difference Vp is zero (low level). In this case, the pixel unit driven by the pixel circuit displays a black state.

When the gate line GATE inputs a low level scan off signal (turning-off signal) or the data line DATA does not update the data signal, the first node N1 can continuously maintain a high level and the second node N2 can continuously maintain a low level, so the pixel unit driven by the pixel circuit can remain in the black state.

(2) From Black State to White State

As shown in FIG. 3 and FIG. 5, when the gate line GATE inputs a scan on signal (as shown in phase A of FIG. 5), the fourth switch M4 is turned on. At this time, if the data signal inputted by the data line DATA is a low level signal, the fourth switch M4 is turned on, and the potential of the first node N1 is at a low level. Because the potential of the first node N1 is low, the third switch M3 is turned off. At the same time because the second switch M2 remains in the turning-on state, the potential of the second node N2 is at a high level.

Because the potential of the first node N1 is low, the fifth switch M5 is turned off. Because the potential of the second node N2 is high, the sixth switch M6 is turned on, and the signal inputted by the second display signal line XFRP is applied to the third node N3. For example, as shown in FIG. 5, the second display signal line XFRP and the common electrode terminal VCOM can be configured to input opposite alternating current square wave signals (one of the signals is at a high level and the other is at a low level), so the amplitude of the voltage difference Vp is high, and the pixel unit driven by the pixel circuit displays a white state.

When the gate line GATE inputs a low level scan off signal or the data line DATA does not input the data signal, the first node N1 can continuously maintain a low level and the second node N2 can continuously maintain a high level, so the pixel unit driven by the pixel circuit can remain in the white state.

It should be noted that, the embodiments of the present disclosure include, but are not limited to, the alternating current square wave driving method adopted in FIG. 4 and FIG. 5. For example, in another embodiment, the common electrode terminal VCOM and the first display signal line FRP can be configured to be electrically connected with a direct current low level terminal (e.g., the second voltage terminal VSS), and at this time, the second display signal line XFRP is configured to be electrically connected with a direct current high level terminal (e.g., the first voltage terminal VDD). Alternatively, the common electrode terminal VCOM and the first display signal line FRP are configured to be electrically connected with a direct current high terminal (e.g., the first voltage terminal VDD), and at this time, the second display signal line XFRP is configured to be electrically connected with a direct current low level terminal (e.g., the second voltage terminal VSS).

In addition, in the above description, when the data signal inputted by the data line DATA is at a high level, the corresponding pixel unit displays a black state; and when the data signal inputted by the data line DATA is at a low level, the corresponding pixel unit displays a white state. The embodiments of the present disclosure include, but are not limited to, this example. For example, the opposite mode can also be adopted. When the data signal inputted by the data line DATA is at a high level, the corresponding pixel unit displays a white state; and when the data signal inputted by the data line DATA is at a low level, the corresponding pixel unit displays a black state. In this case, the first display signal line FRP and the common electrode terminal VCOM are configured to input opposite signals, and the second display signal line XFRP and the common electrode terminal VCOM are configured to input the same signals.

It should be noted that the signals that are opposite to each other as recited in the embodiments of the present disclosure means that when one of the signals is a high level signal and the other signal is a low level signal, it is not required that the amplitude values of the signals are same. The following embodiments are the same in this aspect and will not be repeated herein.

In addition, the embodiments of the present disclosure are described in a liquid crystal display mode in which light is blocked by a liquid crystal layer to display a black state when no voltage is applied, for example, a VA (Vertical Alignment) mode, an IPS (In-Plane Switching) mode, an FFS (Fringe Field Switching) mode and the like. However, it should be noted that the embodiments of the present disclosure include, but are not limited to, these examples. For example, the pixel circuit can also be used in a liquid crystal display mode in which light passes through the liquid crystal layer to display a white state when no voltage is applied, for example, a TN (Twisted Nematic) display mode. In this case, it is only necessary to configure the signals inputted by the first display signal line FRP, the second display signal line XFRP and the common electrode terminal VCOM with reference to the description in this embodiment.

The pixel circuit 100 provided in the embodiments of the present disclosure adopts six switches to reduce the number of the switches used, so the area of substrate occupied by the pixel circuit 100 in a pixel unit can be reduced. At the same time, the risk of current leakage is reduced, so the effect of holding the potentials of the first node N1 and the second node N2 is improved.

Figure 6:
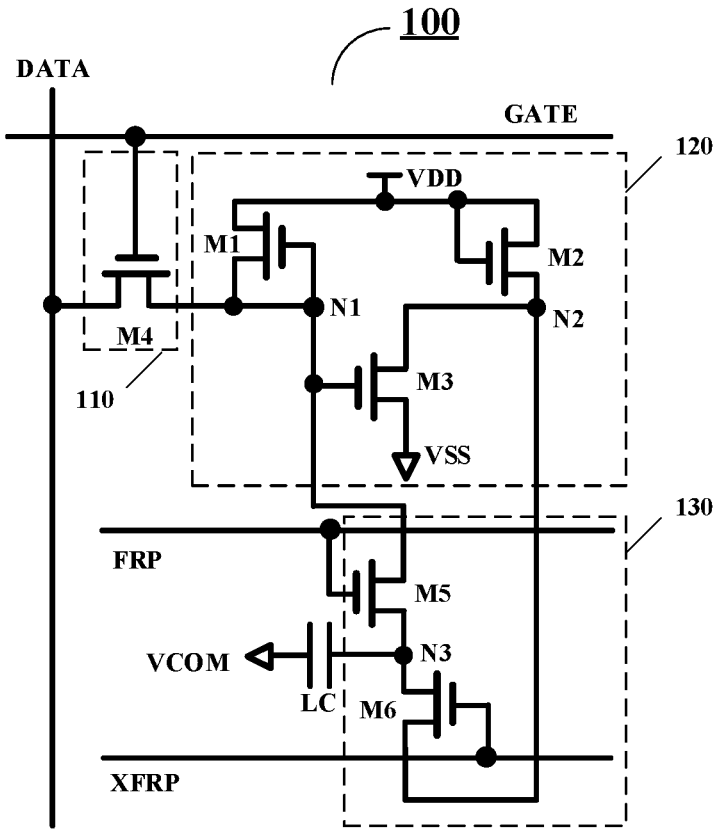
FIG. 6 is a schematic diagram of a pixel circuit according to another example of an embodiment of the present disclosure.

Another example of this embodiment further provides a pixel circuit 100, as shown in FIG. 6, the pixel circuit 100 is different from the pixel circuit as shown in FIG. 3 in the configuration of the fifth switch M5 and the sixth switch M6.

In this example, the fifth switch M5 is configured to apply the level of the first node N1 to the third node N3 under the control of the level of the signal inputted from the first display signal line FRP. For example, the fifth switch M5 can be configured to be turned on under the control of the level of the signal inputted from the first display signal line FRP so as to apply the level of the first node N1 to the third node N3.

In this example, the sixth switch M6 is configured to apply the level of the second node N2 to the third node N3 under the control of the level of the signal inputted from the second display signal line XFRP. For example, the sixth switch M6 can be configured to be turned on under the control of the level of the signal inputted from the second display signal line XFRP so as to apply the level of the second node N2 to the third node N3.

In detail, as shown in FIG. 6, the control electrode of the fifth switch M5 is electrically connected with the first display signal line FRP, the first electrode of the fifth switch M5 is electrically connected with the first node N1, and the second electrode of the fifth switch M5 is electrically connected with the third node N3. The control electrode of the sixth switch M6 is electrically connected with the second display signal line XFRP, the first electrode of the sixth switch M6 is electrically connected with the second node N2, and the second electrode of the sixth switch M6 is electrically connected with the third node N3.

The operation principle of the pixel circuit 100 shown in FIG. 6 will be described in two cases in combination with the signal timing diagrams shown in FIG. 4 and FIG. 5 according to the levels of the data signals inputted by the data line DATA.

(1) From White State to Black State

As shown in FIG. 4 and FIG. 6, when the gate line GATE inputs a scan on signal (as shown in phase A of FIG. 4), the fourth switch M4 is turned on. At this time, if the data signal inputted by the data line DATA is a high level signal, the potential of the first node N1 is high and the potential of the second node N2 is low. Regarding the potentials of the first node N1 and the second node N2, reference can be made to corresponding descriptions of the operation principle about the pixel circuit shown in FIG. 3, and details are not described herein again.

As shown in FIG. 4, in phase B, because the first display signal line FRP inputs a low level signal and the second display signal line XFRP inputs a high level signal, the fifth switch M5 is turned off and the sixth switch M6 is turned on, the low level of the second node N2 is applied to the third node N3. At the same time, the common electrode terminal VCOM also inputs a low level, so the amplitude of the voltage difference Vp is zero (low level) in phase B, and the pixel unit driven by the pixel circuit displays a black state.

In phase C, because the first display signal line FRP inputs a high level signal and the second display signal line XFRP inputs a low level signal, the fifth switch M5 is turned on and the sixth switch M6 is turned off, the high level of the first node N1 is applied to the third node N3. At the same time, the common electrode terminal VCOM also inputs a high level, so the amplitude of the voltage difference Vp is still zero (low level) in phase C, and the pixel unit driven by the pixel circuit continues to display a black state.

In the subsequent phase, the data line DATA may not input the data signal, while the first node N1 can still maintain at a high level and the second node N2 can still maintain at a low level, so the black state can be maintained.

(2) From Black State to White State

As shown in FIG. 5 and FIG. 6, when the gate line GATE inputs a scan on signal (as shown in phase A of FIG. 5), the fourth switch M4 is turned on. At this time, if the data signal inputted by the data line DATA is a low level signal, the potential of the first node N1 is low and the potential of the second node N2 is high. Regarding the potentials of the first node N1 and the second node N2, reference can be made to corresponding descriptions of the operation principle about the pixel circuit shown in FIG. 3, and details are not described herein again.

As shown in FIG. 5, in phase B, because the first display signal line FRP inputs a low level signal and the second display signal line XFRP inputs a high level signal, the fifth switch M5 is turned off and the sixth switch M6 is turned on, the high level of the second node N2 is applied to the third node N3. At the same time, the common electrode terminal VCOM also inputs a low level, so the amplitude of the voltage difference Vp is high in phase B, and the pixel unit driven by the pixel circuit displays a white state.

In phase C, because the first display signal line FRP inputs a high level signal and the second display signal line XFRP inputs a low level signal, the fifth switch M5 is turned on and the sixth switch M6 is turned off, and the low level of the first node N1 is applied to the third node N3. At the same time, the common electrode terminal VCOM also inputs a high level, so the amplitude of Vp is still high in phase C (the absolute value of the voltage difference Vp is still high at this time), and the pixel unit driven by the pixel circuit continues to display a white state.

In the subsequent phase, even if the data line DATA does not update the data signal, the first node N1 can still maintain at a low level and the second node N2 can still maintain at a high level, so the white state can be maintained.

It should be noted that, for other parts of the pixel circuit provided in this example and technical effects, reference can be made to corresponding descriptions of the foregoing examples, and details are not described herein again.

For example, the pixel circuit 100 provided in this embodiment can be used in a low power reflective LCD. In this case, the pixel electrode constituting the display unit LC can be a reflective electrode, or the pixel electrode can be a transparent electrode, and a reflective layer can be separately provided. For example, the low power reflective LCD can be used in a wearable device such as glasses, helmet or the like.

It should be noted that the examples of the signal storage circuit 120 in the pixel circuit 100 provided by the embodiments of the present disclosure can be used in other circuits alone to serve as a memory circuit, for example, for implementing the function of storing data signals.

At least one embodiment of the present disclosure further provides a display panel 10, and for example, the display panel 10 can be a liquid crystal display panel.

Figure 7:
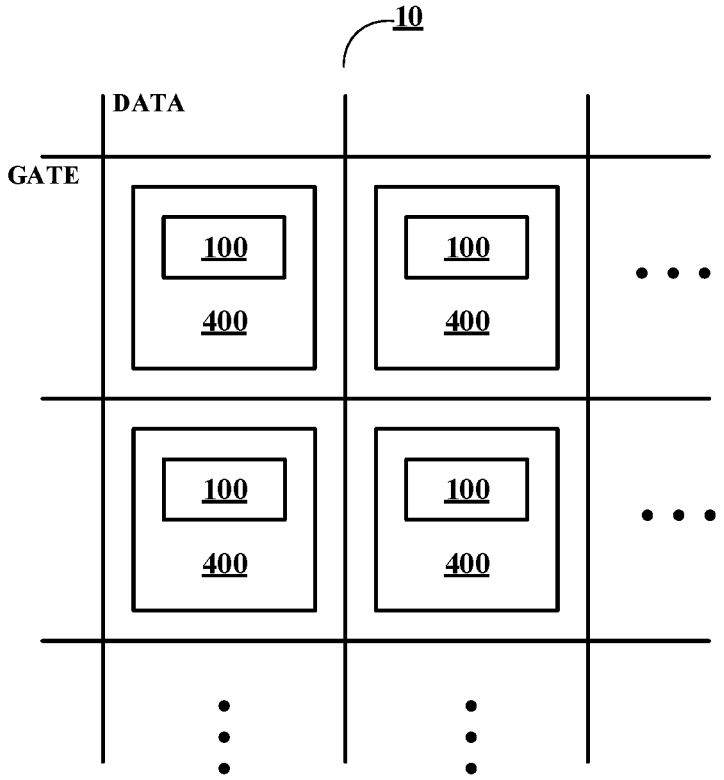
FIG. 7 is a schematic diagram of a display panel according to an embodiment of the present disclosure.

For example, as shown in FIG. 7, a plurality of pixel units 400 are arranged in an array on the display panel 10, and each of the pixel units 400 can include the pixel circuit 100 provided in any embodiment of the present disclosure.

For example, in the case that the display panel 10 is a liquid crystal display panel, each of the pixel units 400 can further include a common electrode, and the common electrode can be disposed on the array substrate or the opposite substrate of the display panel 10. For example, in the IPS or FFS display mode, the common electrode and the pixel electrode can be disposed on the array substrate. For example, in the TN or VA display mode, the pixel electrode is disposed on the array substrate and the common electrode is disposed on the opposite substrate.

It should be noted that the technical effects of the display panel 10 provided in the embodiments of the present disclosure can refer to the corresponding descriptions of the pixel circuits in the embodiments of the present disclosure, and details are not described herein again.

In addition, it should be noted that the display panel 10 provided by an embodiment of the present disclosure can further be an OLED (Organic Light-Emitting Diode) display panel or the like. The present disclosure does not limit the type of the display panel.

At least one embodiment of the present disclosure further provides a driving method that can be used to drive the pixel circuit 100 provided in an embodiment of the present disclosure and the display panel 10 adopting the pixel circuit 100. For example, the driving method includes the following operations.

A signal is applied to the third node N3 through the first display signal line FRP to enable the pixel circuit 100 to display a black state or a white state. A signal is applied to the third node N3 through the second display signal line XFRP to enable the pixel circuit 100 to display a black state or a white state.

For example, specifically, signals identical to each other can be applied to both ends of the display unit LC through the first display signal line FRP and the common electrode terminal VCOM to render the pixel circuit 100 to display a black state; and signals opposite to each other can be applied to both ends of the display unit LC through the second display signal line XFRP and the common electrode terminal VCOM to render the pixel circuit 100 to display a white state.

Alternatively, signals opposite to each other can be applied to both ends of the display unit LC through the first display signal line FRP and the common electrode terminal VCOM to render the pixel circuit 100 to display a white state; and signals identical to each other can be applied to both ends of the display unit LC through the second display signal line XFRP and the common electrode terminal VCOM to render the pixel circuit 100 to display a black state.

The signals opposite to each other indicate that one of the signals is a high level signal and the other signal is a low level signal.

For example, signals applied through the first display signal line FRP, the second display signal line XFRP and the common electrode terminal VCOM include a direct current signal and an alternating current square wave signal.

It should be noted that, for a detailed description of the driving method provided in the embodiment of the present disclosure, reference can be made to the description of the operation principle of the pixel circuit 100 in the related embodiment of the present disclosure, and details are not described herein again.

What have been described above are only specific implementations of the present disclosure, the protection scope of the present disclosure is not limited thereto. The protection scope of the present disclosure should be based on the protection scope of the claims.

What is claimed is:

1. A pixel circuit, comprising a data writing circuit, a signal storage circuit, and a display driving circuit, wherein the data writing circuit is configured to write a data signal into the signal storage circuit according to a scan signal, the signal storage circuit is configured to store the data signal and control the display driving circuit to perform driving for display according to the data signal, and the signal storage circuit comprises a first switch, a second switch, a third switch, a first node, and a second node, wherein a first electrode of the first switch and a control electrode of the first switch are both directly electrically connected with the first node, and a second electrode of the first switch is configured to be electrically connected with a first voltage terminal;

a first electrode of the second switch and a control electrode of the second switch are both directly electrically connected with the first voltage terminal, and a second electrode of the second switch is electrically connected with the second node; and a control electrode of the third switch is electrically connected with the first node, a first electrode of the third switch is electrically connected with the second node, and a second electrode of the third switch is electrically connected with a second voltage terminal.

2. The pixel circuit according to claim 1, wherein a voltage output by the first voltage terminal is higher than a voltage output by the second voltage terminal.

3. The pixel circuit according to claim 2, wherein the first switch, the second switch, and the third switch are thin film transistors.

4. The pixel circuit according to claim 2, wherein the first switch, the second switch, and the third switch are N-type transistors.

5. The pixel circuit according to claim 1, wherein the data writing circuit comprises a fourth switch, a control electrode of the fourth switch is electrically connected with a gate line to receive the scan signal, a first electrode of the fourth switch is electrically connected with a data line to receive the data signal, and a second electrode of the fourth switch is electrically connected with the first node.

6. The pixel circuit according to claim 1, wherein the display driving circuit comprises a fourth switch, a fifth switch, and a third node;

the fourth switch is connected with the third node and a first display signal line, the fifth switch is connected with the third node and a second display signal line, the fourth switch is configured to apply a signal inputted from the first display signal line to the third node under a control of a level of the first node, and the fifth switch is configured to apply a signal inputted from the second display signal line to the third node under a control of a level of the second node; or the fourth switch is configured to apply a level of the first node to the third node under a control of a signal inputted from the first display signal line, and the fifth switch is configured to apply a level of the second node to the third node under a control of a signal inputted from the second display signal line.

7. The pixel circuit according to claim 6, wherein a control electrode of the fourth switch is electrically connected with the first node, a first electrode of the fourth switch is electrically connected with the first display signal line, and a second electrode of the fourth switch is electrically connected with the third node; or a control electrode of the fourth switch is electrically connected with the first display signal line, a first electrode of the fourth switch is electrically connected with the first node, and a second electrode of the fourth switch is electrically connected with the third node.

8. The pixel circuit according to claim 7, wherein a control electrode of the fifth switch is electrically connected with the second node, a first electrode of the fifth switch is electrically connected with the second display signal line, and a second electrode of the fifth switch is electrically connected with the third node; or a control electrode of the fifth switch is electrically connected with the second display signal line, a first electrode of the fifth switch is electrically connected with the second node, and a second electrode of the fifth switch is electrically connected with the third node.

9. The pixel circuit according to claim 8, wherein the fourth switch and the fifth switch are thin film transistors.

10. The pixel circuit according to claim 8, wherein the fourth switch and the fifth switch are N-type transistors.

11. The pixel circuit according to claim 6, wherein the first display signal line is configured to be electrically connected with one of the first voltage terminal and the second voltage terminal, and the second display signal line is configured to be electrically connected with the other of the first voltage terminal and the second voltage terminal.

12. The pixel circuit according to claim 6, wherein the data writing circuit comprises a sixth switch, a control electrode of the sixth switch is electrically connected with a gate line to receive the scan signal, a first electrode of the sixth switch is electrically connected with a data line to receive the data signal, and a second electrode of the sixth switch is electrically connected with the first node.

13. The pixel circuit according to claim 1, wherein the data writing circuit is connected with the first node, and the display driving circuit is connected with the first node and the second node.

14. A display panel, comprising a plurality of pixel units, each of the pixel unit comprises the pixel circuit according to claim 1.

15. A memory circuit, comprising a first switch, a second switch, a third switch, a first node, and a second node; wherein a first electrode of the first switch and a control electrode of the first switch are both directly electrically connected with the first node, and a second electrode of the first switch is configured to be electrically connected with a first voltage terminal;

a first electrode of the second switch and a control electrode of the second switch are both configured to be directly electrically connected with the first voltage terminal, and a second electrode of the second switch is electrically connected with the second node; and a control electrode of the third switch is electrically connected with the first node, a first electrode of the third switch is electrically connected with the second node, and a second electrode of the third switch is electrically connected with a second voltage terminal.

16. A driving method of a pixel circuit, wherein the pixel circuit comprises a data writing circuit, a signal storage circuit, and a display driving circuit, wherein the data writing circuit is configured to write a data signal into the signal storage circuit according to a scan signal, the signal storage circuit is configured to store the data signal and control the display driving circuit to perform driving for display according to the data signal, and the signal storage circuit comprises a first switch, a second switch, a third switch, a first node and a second node, wherein a first electrode of the first switch and a control electrode of the first switch are both directly electrically connected with the first node, and a second electrode of the first switch is configured to be electrically connected with a first voltage terminal;

a first electrode of the second switch and a control electrode of the second switch are both directly electrically connected with the first voltage terminal, and a second electrode of the second switch is electrically connected with the second node; and a control electrode of the third switch is electrically connected with the first node, a first electrode of the third switch is electrically connected with the second node, and a second electrode of the third switch is electrically connected with a second voltage terminal;

the display driving circuit comprises a fourth switch, a fifth switch, and a third node;

the fourth switch is connected with the third node and a first display signal line, the fifth switch is connected with the third node and a second display signal line, the fourth switch is configured to apply a signal inputted from the first display signal line to the third node under a control of a level of the first node, and the fifth switch is configured to apply a signal inputted from the second display signal line to the third node under a control of a level of the second node; or the fourth switch is configured to apply a level of the first node to the third node under a control of a signal inputted from the first display signal line, and the fifth switch is configured to apply a level of the second node to the third node under a control of a signal inputted from the second display signal line;

the driving method comprises:

applying a signal to the third node through the first display signal line to enable the pixel circuit to display a black state or a white state; and applying a signal to the third node through the second display signal line to enable the pixel circuit to display the white state or the black state.

17. The driving method according to claim 16, wherein signals applied through the first display signal line and the second display signal line comprise a direct current signal and an alternating current square wave signal.

* * * * *